United States Patent [19]

Yoda et al.

[11] 3,961,009

[45] June 1, 1976

[54] PROCESS FOR THE PRODUCTION OF A SHAPED ARTICLE OF A HEAT RESISTANT POLYMER

[75] Inventors: Naoya Yoda; Toshiya Yoshi-i; Saburo Fujita; Hiroshi Mochizuki; Hirosuke Yumoto; Masaru Kurihara; Takashi Kubota; Noriaki Dokoshi; Chiaki Tanaka, all of Otsu, Japan

[73] Assignee: Toray Industries, Inc., Tokyo, Japan

[22] Filed: Aug. 1, 1973

[21] Appl. No.: 384,514

Related U.S. Application Data

[63] Continuation of Ser. No. 30,952, April 22, 1970, abandoned.

[52] U.S. Cl. ..... 264/205; 260/47 CP; 260/47 CB; 260/63 N; 260/65; 260/63 R; 260/78 A; 260/78 TF; 264/176 R

[51] Int. Cl.[2] ..... D01F 6/78

[58] Field of Search ..... 264/176 R, 78 TF, 29.2 N, 264/47 CP, 32.6 NT; 264/205

[56] References Cited

UNITED STATES PATENTS

| | | | |
|---|---|---|---|
| 2,710,853 | 6/1955 | Edwards et al. | 260/78 TF |
| 2,824,780 | 2/1958 | Satterthwaite | 264/176 R |
| 2,846,727 | 8/1958 | Bechtold | 264/176 R |
| 2,935,371 | 5/1960 | Magat | 264/176 R |
| 3,179,631 | 4/1965 | Endry | 260/29.2 N |
| 3,242,136 | 3/1966 | Endry | 260/29.2 N |
| 3,484,387 | 12/1969 | Jackson et al. | 260/29.2 N |
| 3,493,540 | 2/1970 | Muller et al. | 260/32.6 N |
| 3,494,823 | 2/1970 | Haller | 264/165 |
| 3,502,762 | 3/1970 | Haller | 264/342 R |
| 3,546,152 | 12/1970 | Bolton | 260/29.2 N |
| 3,551,389 | 12/1970 | Prince | 260/78 TF |
| 3,554,969 | 1/1971 | Long et al. | 260/32.6 NT |
| 3,573,260 | 3/1971 | Morello | 264/331 |
| 3,575,914 | 4/1971 | Long et al. | 260/78 TF |
| 3,575,936 | 4/1971 | Dinan | 260/78 TF |
| 3,577,387 | 5/1971 | Kersten et al. | 264/184 |
| 3,597,391 | 8/1971 | Hara et al. | 260/78 TF |
| 3,598,786 | 8/1971 | Yoda et al. | 260/78 TF |
| 3,619,453 | 11/1971 | Riggs | 260/78 TF |
| 3,619,461 | 11/1971 | Gay | 264/289 |
| 3,629,180 | 12/1971 | Yoda et al. | 260/78 TF |
| 3,673,145 | 6/1972 | Minami et al. | 260/32.6 NT |
| 3,682,860 | 8/1972 | Yoda et al. | 260/30.8 R |

*Primary Examiner*—Harold D. Anderson

[57] ABSTRACT

A process is provided for manufacturing heat resistant polymeric film. A concentrated polymer composition containing solvent is provided, which composition is a solid at room temperature. The composition comprises (a) a polymer having in the repeating units thereof a member selected from the group consisting of precursor units which on heat curing form heterocyclic rings, and a mixture of said precursor units and heterocyclic rings formed from said precursor units and (b) 25-130% by weight of an organic solvent for said polymer, the composition being a solid at room temperature.

According to the process, the solid composition is heated to a temperature above room temperature and is extruded into film at this high temperature to form film at a temperature above room temperature and below the curing temperature of the polymer. The resulting film, prior to curing, is subjected to an extraction step using an extraction compound selected from the group consisting of water, aliphatic and aromatic hydrocarbons, hydrocarbon halide, ketones and hydroxyhydrocarbons, and such curing is achieved by maintaining contact for a time sufficient to extract some of the solvent from the film.

The resulting film is thereafter cured with an effective amount of heat sufficient to cause ring closure of said precursor units, thereby forming the heat resistant polymeric film.

7 Claims, No Drawings

PROCESS FOR THE PRODUCTION OF A SHAPED ARTICLE OF A HEAT RESISTANT POLYMER

This is a continuation of application Ser. No. 30,952, filed Apr. 22, 1970 and now abandoned.

BACKGROUND OF THE INVENTION

1. Field of the Invention

The present invention relates to a process for the production of a shaped article of a heat resistant polymer. More particularly, the invention relates to a process for the preparation of a shaped article of an insoluble, infusible, heat resistant polymer which comprises melt extruding a polymer containing in the polymer chain at least one heterocyclic ring per repeating unit or a polymer wherein a part of said polymer is a precursor of a heterocyclic ring, with a small amount of a solvent to shape said polymer and thereafter heat treating the shaped polymer.

2. Description of the Prior Art

The preparation of a shaped article of heat resistant polymer containing a heterocyclic ring in its molecular structure has hitherto been accomplished by means of a dry shaping process, as follows:

In general, heat resistant polymers having completely cyclized heterocyclic rings are insoluble and infusible and many of them cannot be even dry-shaped. Therefore, it is conventional, for the purpose of shaping a heat resistant polymer, to first prepare a non-ring-closed polymer having such a structure that it is capable of forming a heterocyclic ring, and which is soluble in a specified organic solvent, then to prepare a solution of the non-ring-closed polymer in such solvent, dry-shaped this solution and thereafter subject the dry-shaped solution to heat treatment in a manner to close the intramolecular ring to produce the desired shaped article as a heat resistant polymer.

The steps of a typical dry-shaping process are generally shown as follows:

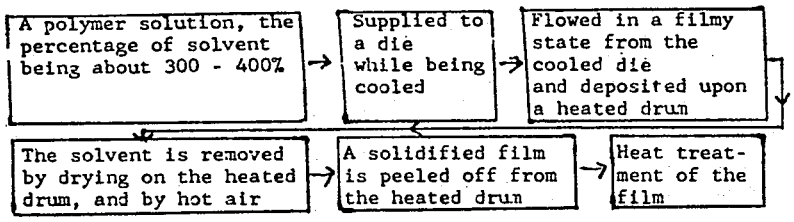

However, there are various technical deficiencies in such dry-shaping processes. For example, when the flowed film is deposited upon a heated drum to remove the solvent by drying, voids tend to be created in the resulting film unless the heating and drying conditions are very carefully controlled. Further, after the heating and drying step, it is extremely difficult to peel the film off the heated drum, with the result that the film is sometimes broken, because of the strong adhesion that exists between the surface of the drum and the film. Also, since it is necessary to use a relatively large amount of solvent in this process, there are various problems brought about in removing and recovering the solvent, for example, the necessary equipment is complicated and expensive and the process is slow.

As prior art, U.S. Pat. No. 3,428,602 describes a process involving flowing a dilute solution of polyamide acid into a thin film, removing the solvent to some extent, shaping the thin film into a thick film by calender rolls and finally heat curing the thick film to obtain a thick shaped article of polyimide. Because this process also uses a solution of polyamide acid containing a large amount of the solvent, this process is accompanied with deficiencies similar to those heretofore discussed. Further, there are other deficiencies such as the difficulty of obtaining an article having the shape of a uniform plane, because shaping is carried out using rolls, and because deterioration of the physical properties of the material is inevitable as the thin film is heated and shaped by means of rolls.

Accordingly, an object of the present invention is to eliminate the aforementioned deficiencies of the conventional process and to provide a superior process for the preparation of a shaped article of a heat resistant polymer containing a heterocyclic ring which becomes ultimately insoluble and non-meltable.

SUMMARY OF THE INVENTION

The present invention relates to a process for the production of a shaped article of a heat resistant polymer which comprises heating, melting, extruding and shaping a polymer having at least one heterocyclic ring and/or a precursor structure thereof per repeating unit in the polymer chain, the ring closing ratio inside the molecule as a whole being 15 – 100%, the polymer being dissolved in an organic solvent which solvent is present in an amount of 15 – 150% by weight, based upon the weight of the polymer, preferably 25 – 130% by weight based on the weight of said polymer, and thereafter heat curing the extruded product.

The term precursor structure of the heterocyclic ring, as referred to in the present invention, means a bonding structure capable of forming the desired heterocyclic ring by means of a ring closing inside the molecule, or by means of a rearrangement reaction which can be caused by heat treatment.

The closed-ring ratio inside the molecule, is defined as follows. It should be noted that a heat resistant polymer contains both a non-ring-closed polymer and a ring-closed polymer obtained by heat treating the non-ring-closed polymer. The value of the closed-ring ratio is based on a completely closed-ring state defined as 100% and a completely non-ring-closed state as 0%. Specifically, the closed-ring ratio is a value expressed by the following formula:

$$\frac{\text{Total number of heterocyclic rings}}{\text{Total number of precursor structures of all heterocyclic rings} + \text{Total number of heterocyclic rings}} \times 100$$

For example, in case the heterocyclic ring is an imide ring, the precursor structures are bonded structures of the following amide acid (I), amide acid ester (II) and iminolactone ring (III).

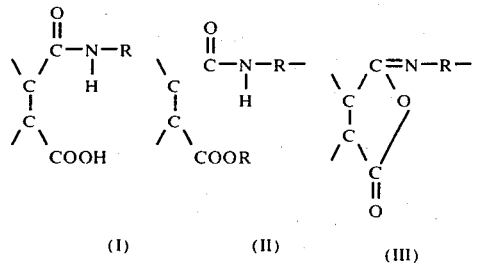

(I) (II) (III)

In such case the closed-ring ratio inside the molecule may be determined by expressing the ratio of weight of the imide rings to the weight of imide rings plus weight of the amide acid, or amide acid ester, or iminolactone ring in the polymer, and multiplying by 100.

Such a value may be easily calculated by determining the quantity of the ring closed-portion and the non-ring closed portion by infrared absorption spectrum, NMR or other known means.

According to this invention, it is preferable that a polymer composition containing an organic solvent, used as a starting material for the shaping process of the present invention, should possess the following physical properties. Preferably, it has a softening point below 270° C, and is not subject to gelation or loss of fluidity and does not undergo any precipitation phenomenon even if it is heat treated at a shaping temperature for less than 2 minutes.

The softening point as referred to herein is obtained by measuring the flowing (softening) starting temperature and extruding the polymer composition using the apparatus of ASTM P1238-57T, elevating the temperature of the extruded composition under a load of 25 kg as measured by a plastometer.

The heterocyclic rings contained in polymers according to the present invention include imide rings, imidazole rings, benzoxazole rings, benzimidazole rings, benzoxazdinone rings, imidazopyrrolone rings, hydantion rings, oxathiadiazole rings and oxadiazole rings. These heterocyclic rings may be contained singly in the polymer or a plurality of different ones of these rings may be contained in the polymer and they may occur either regularly or at random.

The following may be cited as specific example of heat resistant polymers capable of being made into shaped articles by the process of the present invention: heterocyclic ring polymers such as polyamideimide, polyimide, polybenzoxazole, polybenzimidazole, polybenzoxadinone, polyester-imide, polyimidazopyrrolone, polyhydantoin, polyimide-hydrazide and polyox-a(thia)diazole and copolymers thereof. In the copolymer, as mentioned above, each copolymeric component may be arranged regularly or at random. No particular limit is applicable to the existing ratio of the copolymeric copolymeric components.

With reference to a case wherein a heterocyclic ring co-exists with another linkage of a functional group such as polyamide-imide and polyester-imide, no particular limit is applicable to the existing ratio of the heterocyclic ring to the amount of other linkage. Also, there is no particular limitation with respect to the regularity or randomness of occurrence of the heterocyclic ring and of the functional group linkage.

The heat resistant polymer of the present invention must have a closed-ring ratio of at least about 15%.

If the closed-ring ratio is less than 15%, application of the process of the present invention becomes practically difficult on account of generation of a volatile low molecular weight compound such as water or alcohol in concomitance with the ring closing inside the molecule. In this sense, it may be said that the larger the ring closing ratio in the polymer, the more preferable the compound. However, actually upon extrusion shaping the polymer containing the organic solvent, as mentioned above, it is necessary that a composition containing 15 – 150% of solvent should have a softening point of less than 270° C and even when a heat treatment at an extrusion shaping temperature is carried out for less than 2 minutes, it should not gelate in a manner to lose its fluidity or cause a precipitation phenomenon and, to that end, it is preferable not to increase the ring closing ratio in many cases.

For example, in the case of a heat resistant polymer having (besides a heterocyclic ring) a polar group such as an amide bond, an ester bond, a carbonyl group or an ether bond, even when the ring closing ratio is relatively high, indeed even when it is 100% as occasion demands, a polymer composition having the aforementioned physical properties may be obtained. On the other hand, in case of a heat resistant polymer not having such a polar group at all besides a heterocyclic ring, it is necessary to subject a polymer composition having a low ring closing ratio to shaping.

For example, with reference to polyamide-imide, it is possible properly to change the ratio of an amide bond to an imide ring by selection of monomers and the amount of the copolymeric monomer. In case the existing ratio of the amide to the imide exceeds 85:15 and number of the amide group increases, even if the ring closing ratio is more than 95% or when the rings are substantially closed, the polymer may be made into a shaped article by the process of the present invention. In case in polyamide-imide, an ether bond or carbonyl group is further contained, even when the ratio of the amide bond to the imide ring is deviated more toward the imide ring, it is possible to subject the completely ring-closed polymer to shaping.

As the organic solvent used in the present invention, any solvent is suitable insofar as it has affinity with the polymer subjected to the process of the present invention; however, it should have a boiling point of at least about 150° C, and 200° C or above is preferable. As preferred examples, N-methyl-2-pyrrolidone (NMP), N,N-dimethyl acetamide (DMAC), N,N-dimethyl formamide (DMF), N,N-dimethylmethoxy acetamide, N-methyl caprolactam, dimethyl sulfoxide, tetramethylene urea, pyridine, dimethylsulfone, hexamethylphosphoramide, tetramethylenesulfone, formamide, butyrolactam, N-acetyl pyrrolidone, m-cresol and p-cresol may be cited. A mixed solvent containing an organic solvent other than those mentioned above, for example, benzene, xylene, benzonitrile, dioxane, toluene and cyclohexane, may be used provided it is capable of preparing a polymer composition containing a solvent meeting the aforementioned conditions. By heating a polymer containing at least 15% by weight of such an organic solvent, said polymer becomes thermoplastic for the first time and becomes subject to melt shaping at a proper temperature lower than the boiling point of the organic solvent.

If the content of the organic solvent is below 15% by weight based on the weight of the polymer, even when the polymer is heated, it fails to exhibit fluidity and substantially cannot be melt shaped. When the content of the organic solvent exceeds 150% by weight based on the weight of the polymer, the system per se becomes essentially a solution, and the shape retentivity after melt extrusion tends to be insufficient and there is an increased possibility of introducing voids during the heat treatment, about which mention will be made later. In this case the expression "shape retentivity" refers to the property of the resultant film which has self-supporting physical qualities while the process is being carried out.

A polymer composition having such a preferable concentration of solvent may be polymerized within such a range of concentration from the outset of the polymerization reaction. Also it may be polymerized in a system wherein the content of the solvent is larger and wherein, after completion of the polymerization reaction, the solvent is removed by any desired means to control the concentration to a proper value.

The polymer composition so obtained, containing solvent within said range, may be handled as a solid at a temperature from 0° C to room temperature. It is also possible to process such composition into a particulate state or into pellets, in which case the physical handling of the composition is very simple.

Upon carrying out melt extrusion shaping, this particulate or pelletized composition may be melted and extruded. However, it is more convenient to carry out the polymerization reaction and the extrusion shaping continuously and, after completion of the polymerization reaction, to supply said composition directly in a molten state to an extruder.

For the extrusion shaping an ordinary extruder may be used and there is no structural limitation applicable. However, when the amount of solvent is especially small, an extruder having good mixing and kneading properties, such as a Dulmadge type extruder, is preferably used.

The ultimate shape of the shaped article is not particularly limited; on the contrary it may be fibrous, filmy, sheet, thick film or any other specific shape depending upon the design of the die. However, the present invention is especially effective commercially for shaping a fiber, film or sheet article.

Heating for melting may impart a fluidity sufficient to enable the composition to be extrusion shaped. Elevation of the temperature to a level higher than necessary may result in foaming of the composition upon being extruded. Therefore, care must be taken. The heating temperature is normally lower than the boiling point (at atmospheric pressure) of the solvent used, preferably at least 5° C lower than the boiling point.

The extrusion shaped article is subjected to heat treatment to form the final product. The object of this heat treatment is to remove the remaining organic solvent, and in case of a non-ring-closed polymer it has the further object of opening the ring. Further, it obtains a more excellent, insoluble, non-meltable heat resistant polymer by increasing the degree of polymerization and cross-linking due to the occurrence of a solid phase polymerization reaction.

It is necessary to make the heat treating temperature higher than the extrusion shaping temperature; normally it falls within the range of about 200° – 500° C. Again, it is preferable to carry out the heat treatment step in an inert gas atmosphere. It is convenient to impart shape retentivity by some means or other to the shaped article prior to this heat treatment step, and to eliminate the adhesion of the surface of said shaped article. Mere cooling accomplishes this.

Cooling is carried out under temperature conditions wherein difference between extruding temperature, and the temperature of atmosphere out of the extruding die, lies between 350° and 30° C.

When the upper limit is more than 350° C, the solvent is frozen; as a result, the flexibility of the shaped article is lost. On the other hand, when the lower limit is less than 30° C, it is not possible to impart sufficient shape retentivity to the shaped article. It is a matter of course that in case this method is taken, it is necessary to cool the shaped article of the polymer composition having a relatively large amount of a solvent to a temperature as low as possible. As a cooling medium, cooled air, or a cooling bath using a liquid through which the composition is passed, may be employed.

Also it is effective to contact the shaped article with a compound having affinity for the organic solvent contained in the polymer. However, its affinity for the polymer per se should not be so great as to form a solid at room temperature.

In the use of a surface material having affinity for the polymer in a film-forming operation, when the extruded shaped article is wound around a metal drum, it is possible to avoid adhering of the shaped film to the metal surface. Such a treatment may be carried out by immersing the shaped article in a bath of the compound having affinity for the polymer, or spraying said compound on the shaped article. The contact time required for imparting the self-supporting properties to the shaped article is very short. This may be carried out considerably faster than when the self-supporting property is imparted by cooling. When contact of the polymer with the compound is longer than necessary, the degree of devitrification of the polymer is increased and, at the same time, the extruded article loses softness, therefore contact for a long period of time is not desirable. Sometimes this produces an opaque whitening which cannot be eliminated even when the polymer is heat treated; the physical properties of such a polymer are harmed as well. Proper softness allows the subsequent heat treating of the polymer to be accomplished very smoothly. Any compound having the aforesaid properties may be used, for example, water, hydrocarbons (aliphatic and aromatic), hydrocarbon halide, ketones and hydroxyhydrocarbons. However, water is especially preferred. Also, at least two of these may be used in admixture. As specific compounds other than water, acetone, heptane, carbon tetrachloride, ethylene glycol and tetralin may be cited.

On the other hand, it is possible to adopt a method not particulary imparting any self-supporting properties to the extruded shaped article to be subjected to the heat treatment.

A shaped article melt-extruded at a given temperature is in a softened state at that temperature. However, as the temperature lowers, it becomes solidified. Heat treating a shaped article whose temperature is higher than the temperature at which solidification occurs, namely, a shaped article in a softened state, has advantages. The removal of solvent is smooth, the planar property of the resulting shaped article is good, and removal of the solvent as well as the ring closing reaction within the molecule are rapid as compared to the step of treating the shaped article in the solid state.

When the process of the present invention is compared with the aforementioned dry film making process and the advantages and disadvantages of the two processes are examined, they are as follows.

In contrast to conventional processes which have required a solvent concentration of about 300 – 600;% by weight, the shaping process of the present invention requires a concentration of only about 15 – 150% by weight.

The concentration of the solvent is the percentage of the weight of the solvent based on the weight of the polymer. The amount of the solvent used in the shaping process of the present invention is less than one quarter to one half of that in the dry film making process.

The use of only a small amount of organic solvent is a great advantage in terms of production cost.

In the dry film making process, the solvent must normally be removed by drying. However, the drying speed of such a glutinous substance is very slow; because of that the film making speed is necessarily slow. Also, in this drying process formation of bubbles is always a matter of concern since elimination of formation of bubbles is almost impossible. Further, the solvent removed by drying must naturally be recovered, however, the recovery ratio is at most about 90% and considerable loss is inevitable. As compared with the dry film process having such difficulties, the shaping process of the present invention, such difficulties are remarkably absent and the cost is much less. In dry film making, because the drying speed of the solvent is slow, a very long drying zone is required. In addition, in order to prevent foaming, strong measures must be taken to prevent dust in a film making chamber as a whole. Also, because large quantities of solvent are removed by drying, in order to negate the possibility of explosion, it is necessary to make all the machines and instruments as well as their housings explosion proof. On the other hand, in the present invention, the mere provision of an extruder suffices and the present invention is very simple and convenient in terms of the apparatus needed.

As such, the present invention may be utilized for a heat resistant polymer containing a heterocyclic ring which has no definite melting point. As another characteristic of the present invention, because the shaping is carried out in the molten state, the planar property of the shaped article produced is very excellent.

The process of the present invention is mainly preferably used for shaping a film. However, it is effectively utilizable for fibrous matter and for thick film-shaped articles as well.

The present invention will be explained with reference to a considerable number of examples.

The viscosity in these examples is measured as follows:

$$V_{inh} = \frac{\text{Natural log } (F_2 - F_1)}{C}$$

where $F_2$ means flowing down time of the solution, $F_1$ means flowing down time of the solvent, and C stands for the concentration of the polymer in the solution, in grams of polymer per 100 ml of solution. Ordinary viscosity shows a value measured at 30° C of 0.5 g/100 ml N-methyl-2-pyrrolidone.

R.S. used in the following examples represents percentage by weight of solvent based on weight of polymer, i.e.

$$R.S. = \frac{\text{Solvent (Weight)}}{\text{Polymer (Weight)}} \times 100$$

EXAMPLE 1

In 289 parts of N-methyl-2-pyrrolidone (NMP), 234.2 parts of butane-1,2,3,4-tetracarboxylic acid (BTC) and 198.3 parts of 4,4'-diaminodiphenylmethane (DAM) were dissolved, and the solution obtained was stirred and heated to 200° C. In order to supplement NMP (and water) distilled off during the period, NMP in an amount corresponding to the distilled off amount of NMP was added periodically to the system. A viscous solution obtained after 4 hours was considered a high molecular weight mixture having the following structures determined from the infrared spectrum. The ratio of ring closing inside the molecule of this high molecular weight mixture was 85%.

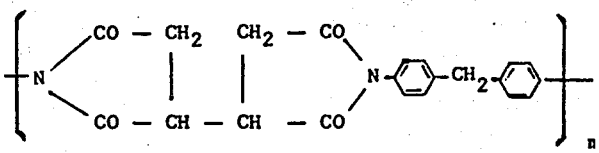

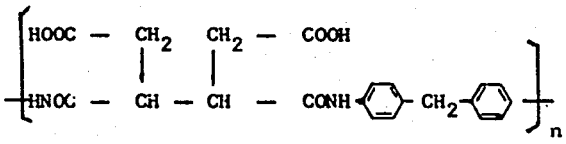

(wherein *m* and *n* stand for degrees of polymerization).

By concentrating this solution under a reduced pressure, samples having concentrations of the solvent (based on the weight of the polymer) of 8, 15, 21, 58, 67, 80, 100, 135, and 155% were prepared. After making these samples into small lumps, they were supplied to an extruder having a diameter of 20 mm heated to 180° C. At the tip of the extruder, a 150 mm wide film making die was provided and this die was also heated to 180° C. At first, when a material having a solvent concentration of 8% was charged, the product from the die did not attain the condition of a good film. Next, when materials having solvent concentrations of 15, 21, 58, 67, 80, 100 and 135% were melt extruded, all of them were easily extruded from the spinneret in film states without encountering any problem. On the other hand, when a material having a solvent concentration of 155% was similarly melt extruded, the shaped article obtained flowed and its shape could not be retained.

Films obtained from materials having solvent concentrations of from 15 to 135% were immediately placed on a metal belt heated to 200° C and heat treated at 200° C for 2 minutes, at 250° C for 3 minutes and at 300° C for 3 minutes. Tenacious light brown films were obtained. The ratios of ring closing inside the molecules of these films were roughly 100%. When attempts were made to measure the melting points of these films, it was found that they had no melting points, but these films began to decompose when heated to temperatures above 350° C.

These films had tensile strengths of 11.6 kg and elongations of 13%, showing excellent heat resistance.

EXAMPLE 2

A three-necked flask equipped with a stirrer and a nitrogen inlet was charged with 68.486 parts of N,N'-diethoxycarbonyl-4,4'-diaminodiphenylmethane, 38.424 parts of trimellitic anhydride and 200 parts of N-methylpyrrolidone and the contents were stirred at 195° – 200° C for about 2 hours to cause polymerization. The polymer obtained was very viscous, having a solution viscosity at 150° C of more than 5000 poises and the polymer content was 50%. The polymer ratio of ring closing was 85%.

After completion of the polymerization operation, while retaining the temperature of the polymer at 200° C, the polymer was continuously supplied to a small extruder heated to 190° C and was melt extruded and formed into a film from a spinneret that was also heated to 195° C. A film melted and came out of the spinneret and was heated by means of a hot air dryer heated to 250° C to remove a greater part of the solvent. Thereafter, the film was introduced into a tenter type heat treating apparatus heated to 300° C and heat treated under tension.

The film obtained was a tenacious yellowish brown one, having a tenacity of 14.6 kg/mm², an elongation of 14.8% and a folding endurance (thickness 50 $\mu$) of 1600 times.

EXAMPLE 3

In 250 parts of tetrahydrofuran, 38.42 parts of trimellitic anhydride was dissolved, the solution obtained was cooled to 0° C, to which 19.83 parts of solid 4,4'-diaminodiphenylmethane were added little by little.

After the mixture was reacted at 0° – 210° C for 2 hours, it was flowed into a product obtained by dissolving 44.4 parts of dicyclohexylcarbodiimide in 500 parts of tetrahydrofuran. The reaction temperature within the system was kept at 0° – 10° C in reacting the system at 20° C for 10 hours and thereafter the reaction product was filtered to remove dicyclohexyl urea to obtain diiminolactonedicarboxylic acid (I) having the formula

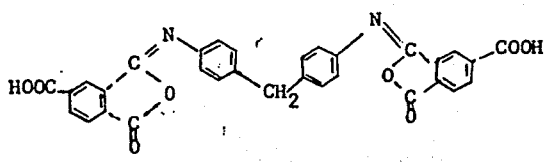

(I)

In 200 parts of N-methyl-2-pyrrolidone, 29.1 parts of the compound (I) were dissolved. To the resultant solution, 12.51 parts of solid diphenylmethane diisocyanate were added and when the mixture was heated at 180° C for 5 hours, it became a viscous polymer solution. The ring closing ratio of this polymer was 92%. While keeping the polymerization temperature at 180° C, this polymer was continuously supplied to a small extruder heated to 190° C and from a spinneret also heated to 190° C, the polymer was melt extruded and made into a film. The softened film coming out in a molten state from the spinneret was immediately introduced to a metal drum heated to 200° C, which was gradually heated to elevate the temperature to 320° C. The heating period was 7 minutes. This film had a tenacity of 15.4 kg/mm², an elongation of 13.5% and a folding endurance (thickness 50 $\mu$) of 1280 times.

EXAMPLE 4

Using 25 parts of N-methylpyrrolidone as a solvent, 8.008 parts of 4,4'-diphenylether diamine and 7.324 parts of bis(trimellitic anhydride)anhydride) were stirred at room temperature for 30 minutes and thereafter the two compounds were stirred while being heated to 190° C for 5 hours. The highly viscous polymer (ring closing ratio 85%) solution produced was continuously supplied to a small extruder heated to 190° C and from a spinneret also heated to 190° C, the polymer was melt extruded and made into a film. The softened film produced in a molten state from the spinneret was directly introduced to a metal belt heated to 200° C, the temperature of which was gradually elevated and heated at 310° C for 5 minutes. The film produced was a tenacious brown one, having a tenacity of 16.5 kg/mm² and an elongation of 18.5%.

EXAMPLE 5

Butanetetracarboxylic acid and 4,4'-diaminodiphenylether (DAE) were heated and polymerized in NMP to obtain a solution having a concentration of the solvent of 100% (concentration of the polymer 50%).

This solution was concentrated while being heated to 80° C under a reduced pressure to make the concentration of the solvent 32%. The resulting polymer was pulverized. In spite of containing 32% of the solvent, this powder was dry and the ratio of ring closing inside the molecule was 70%. The powder was supplied to a small candle type spinning machine, melt spun at 190° C, the spun filaments were immediately wound around a roller heated to 230° C and heat treated at 340° C. The yarn obtained was slightly brownish and tenacious.

EXAMPLE 6

In NMP, 4-chloroformylphthalic anhydride and 4,4'-diaminodiphenylmethane were polymerized to obtain a solution of a polyamide-imide precursor mixture having the following structure.

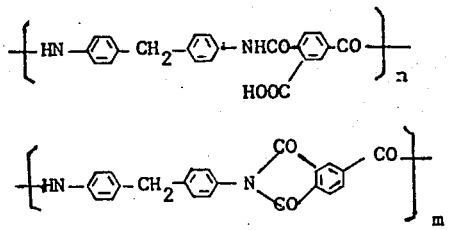

After suspending this solution in a poor solvent of the methanol water type, using a large amount of water, the polymer was precipitated again and filtered to obtain a particulate polymer containing hardly any organic solvent. The ratio of ring closing inside the molecule of this polymer was 33%. The polymer per se was supplied to an extruder heated to 170° C and attempts were made to melt spin it, however, the polymer was not melted and the attempt did not succeed. Subsequently, said particulate polymer was allowed to stand exposed to a vapor of NMP and to absorb NMP to make the concentration of the solvent 23%. Even when the concentration of the solvent became 23%, the particles did not feel wet, but appeared dry. These particles were supplied to an extruder heated to 170° C and melt extruded. They were easily melted and came out from a T type die (which was also heated to 170° C) in a filmy state.

This film was slightly yellowish, soluble in NMP and DMAC and softened when heated to a temperature higher than 120° C. This film heated to 170° C was placed inside a tenter type heat treating instrument, heated from both sides by radiation heaters and heat treated for about 6 minutes so that the film temperature became 280° – 300° C. At this occasion, the heat treatment was carried out such that at first it was carried out under no tension and as the removal of the solvent proceeded it was carried out gradually under tension. The film obtained had a ratio of ring closing inside the molecule of 100%, being yellowish and tenacious, insoluble in an organic solvent and having no melting point. This film had a tensile strength of 12 kg/mm$^2$ and an elongation of 42%. Even when it was kept in an atmosphere at 180° C for a long period of time, it did not experience any substantial change in physical properties, exhibiting excellent heat resistance.

EXAMPLE 7

By polymerizing in DMAC, 4-chloroformylphthalic anhydride, hydroquinone and 4,4'-diaminodiphenylmethane, a solution of a polyester-imide precursor mixture as shown by the following formulae was obtained. The ratio of ring closing inside the molecule of said precursor mixture was 63%.

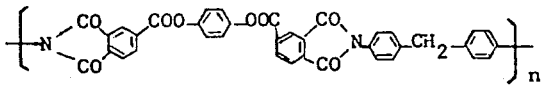

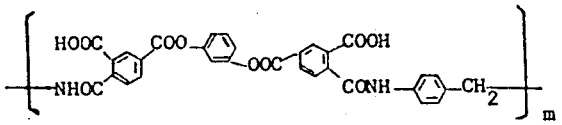

After heating and drying this DMAC solution, it was cut into pellets. The concentration of the solvent in the pellets obtained was 50%. These pellets were supplied to a vent type extruder and while removing some amount of the solvent from the vent, the pellets were melt extruded in a filmy state and the softened film obtained was heat treated at 280° C. The film obtained was a tenacious brownish polyester-imide film. The ratio of ring closing inside the molecule was roughly 100%.

EXAMPLE 8

By polymerizing dihydrazide isophthalate and pyromellitic anhydride in NMP, a solution of a precursor mixture as shown below was obtained. The ratio of ring closing inside the molecule was 60%.

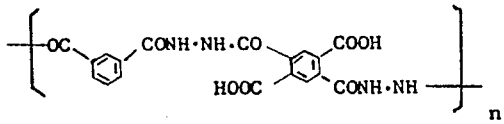

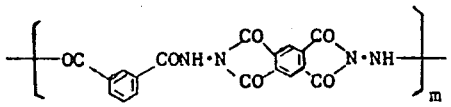

This solution was concentrated by heating at 70° C under reduced pressure to make the concentration of the solvent 45%, thereafter it was made into a small lump, which was supplied to an extruder heated to 170° C and melt extruded and made into a film. The film coming out from the spinneret was immediately heat treated in hot air at 300° C for 5 minutes. The film obtained was transparent, somewhat yellowish and tenacious.

EXAMPLE 9

Using 4,4'-diaminodiphenylmethane (DAM), pyromellitic dianhydride (PMDA), 4-chloroformylphthalic anhydride (TMC) and isophthalic acid chloride (IPC) at a molar ratio of 3:1:1:1, the mixture was copolymerized in NMP to obtain a polymer solution whose inherent viscosity at a concentration of NMP of 0.5% at 30° C was 0.80. The ratio of ring closing inside the molecule of said polymer was 52%. This solution was concentrated under a reduced pressure to make the concentration of the solvent 40%, supplied to an extruder having a diameter of 30 mm heated to 140° C and melt extruded and made into a film from a spinneret heated to 150° C. The softened film coming out of the spinneret was immediately placed inside a hot air dryer heated to 200° C, heated at 200° C for 3 minutes and continuously the temperature of said dryer was gradually elevated to 230° C at which temperature the film was heated for 4 minutes. The film obtained was a tenacious yellowish brown one whose ring had been completely closed.

EXAMPLE 10

Using DAM and PMDA at a molar ratio of 1:1, the two compounds were polymerized in NMP to obtain a high molecular weight compound solution whose inherent viscosity at a concentration of 0.5% in NMP at 30° C was 0.5 and whose ratio of ring closing inside the molecule was 80%. By treating this solution the same as in Example 1, it was possible to obtain a tenacious, heat resistant film.

EXAMPLE 11

Using DAM, PMDA and TMC at a molar ratio of 2:1:1, they were copolymerized in NMP to obtain a high molecular weight solution having a logarithm viscosity of 0.7 and a ratio of ring closing inside the molecule of 80%. By treating this solution the same as in Example 7, it was possible to obtain a tenacious, heat resistant film.

EXAMPLE 12

Using 4,4'-diaminodiphenylether and benzophenonotetracarboxylic dianhydride at a molar ratio of 1:1, they were polymerized in DMAC to obtain a high molecular weight compound solution having an inherent viscosity of 0.9 and a ratio of ring closing inside the molecule of 70%. By treating this solution the same as in Example 4, it was possible to obtain a tenacious, heat resistant film.

EXAMPLE 13

Using trimetllitic anhydride (TMA) and methylenediphenylene diisocyanate (MDI) at a molar ratio of 1:1, they were heated and polymerized in NMP to obtain a very viscous high molecular weight compound solution after the polymerization proceeded while generating carbon dioxide. This high molecular weight compound solution had a solvent concentration of about 50%, an inherent viscosity in NMP at 30° C of 1.3 and a ratio of imide ring closing inside the molecule of 72%. While being heated at 140° C, this solution was continuously supplied to an extruder heated to 140° C and melt extruded into a filmy state from a spinneret heated to 150° C. The film coming from the spinneret was immediately introduced to a metal belt in an inert atmosphere heated to 280° C and heat treated for about 5 minutes. The film obtained was yellowish brown, had a ratio of imide ring closing of about 100%, had no melting point and had a softening point of 280° C.

This film had a tensile strength of 12.7 kg/mm², an elongation of 22%, and even when it was treated in air at 250° C for 10 hours, no substantial change of physical properties took place. It showed good heat resistance.

EXAMPLE 14

In 250 parts of N-methylpyrrolidone, 105.672 parts of trimellitic anhydride was dissolved, to the resultant solution 75.422 parts of solid p-aminobenzoic acid was added and the mixture was heated at 200° C and stirred for 2 hours. Water produced upon this occasion was distilled off outside of the system and the final moisture content was 120 ppm. To this solution (in a slurry state), 250.250 parts of 4,4'-diphenylmethane diisocyanate and 86,459 parts of trimellitic anhydride were added and when the mixture was continuously stirred at 170° C for 1.5 hours, a very viscous polymer was obtained. This polymer had a solvent content of 60%, a ratio of ring closing of 95% and an inherent viscosity of 0.70 and when it was cooled to room temperature, it became a solid. This solid was pulverized and formed into polymer chips. The chips were supplied to an extruder having a diameter of 45 mm heated to 175° C and melt extruded by a screw having a groove depth that gradually decreased. A T type spinneret provided at the tip of the extruder was also heated to 175° C, having a width of 300 mm and a lip gap of 0.5 mm. The polymer extruder in a film state from this spinneret was wound around a cooling rotary drum located immediately below the spinneret, continuously cooled to 20° C and thereafter it was continuously introduced into a tenter type heat treating machine. The interior of this heat treating machine was heated to 330° C by hot air having an oxygen concentration below 10%. After the film underwent heat treatment while both edges were held by clips for about 10 minutes, the film coming out of the tenter was wound after both edges were cut off. The film obtained was about 50 μ thick. It was tenacious brownish polyamide-imide film. Some of the values of the physical properties of this film are shown in Table 1.

Table 1

| Characteristics | Measured value | Measuring method |
|---|---|---|
| Tensile strength | 10.6 kg/mm² | ASTM D882-64T |
| Elongation | 23% | ASTM D882-64T |
| Dielectric strength | 182 KV/mm | ASTM D149-64 |
| Dielectric constant (1 KC 25°C) | 4.5 | ASTM D150-64T |
| Dissipation factor | 0.0067 | ASTM D150-64T |
| Pyrolysis starting temperature (in air) | 450°C | TGA |
| Density | 1.37 | Density gradient pipe method |
| Folding endurance (50μ thick) | 8700 times | JISP-8115 |

EXAMPLE 15

In a manner the same as in Example 14, from 172.917 parts of trimellitic anhydride and 123.417 parts of p-aminobenzoic acid, an adduct was synthesized. The ratio of an imide ring closing of the adduct was roughly 100%. To said adduct, 115.278 parts of trimellitic anhydride and 471.375 parts of N,N'-dimethoxycarbonyl diphenylmethane-4,4'diisocyanate were added and when the mixture was reacted at 180° C for 3 hours, a polymer solution having a polymer concentration of 56% and an inherent viscosity of 0.86 was obtained. In an infrared spectrum of this film, absorption of an imide bond was observed at 5.64μ 5.644μand 5.89μ and absorption of an amide bond was observed at 6.02μ.

This polymer had a tenacity of 12.2 kg/mm² and an elongation of 23%.

EXAMPLE 16

249.769 parts of trimellitic anhydride, 124.788 parts of p-aminobenzoic acid and 200 parts of N-methylpiperidone were reacted at 200° – 205° C for 2 hours. To the reaction product 226.395 parts of 2,4-tolulene diisocyanate and 100 parts of N-methylpyrrolidone were added and the mixture was heated at 190° C and stirred for 1 hour to obtain a very high molecular weight polymer having a solvent concentration of 67%, a ratio of ring closing inside the molecule of 92% and an inherent viscosity of 1.26. The same as in Example 14, a film was made from this polymer. The film obtained was excellent in mechanical strength, showing a folding endurance of a 50μ thick film of 9200 times (JISP-8115).

EXAMPLE 17

In N-methylpyrrolidone, 384.24 parts of trimellitic anhydride and 482.48 parts of 4-amino-4'-carboxybiphenylketone were reacted at 190° C for 3 hours to synthesize an adduct, to which adduct 901.50 parts of p-phenylene diisocyanate and 192.12 parts of trimellitic anhydride were added. The mixture was reacted at 170° C for 1 hour and at 210° C for 30 minutes to obtain a polymer solution having an inherent viscosity of 0:81 (ratio of ring closing 97%).

This solution was concentrated under a reduced pressure to make the concentration of the solvent 60%, the concentrated solution was supplied to a vent type extruder heated to 170° C and melt extruded and made into a film from a spinneret heated to 170° C.

The thin film coming out from the die was continuously introduced into a tenter type heat treating apparatus heated to 280° C and heat treated under tension. The film obtained was yellowish brown, tenacious and flexible.

EXAMPLE 18

In N-methylpyrrolidone, 48.436 parts of 1,4,5-naphthalenetricarboxylic anhydride and 42,646 parts of 4-amino-4'-carboxybiphenyl were reacted at 190° C for 3 hours, to the reaction product 10.906 parts of pyromellitic dianhydride, 78.563 parts of N,N'-dimethoxycarbonyl-4,4'-diaminodiphenylmethane and 20 parts of N-methylpyrrolidone were added, and the mixture was heated at 170° C and stirred for 2hours to obtain a solution of a polymer having a concentration of the polymer of 59% and an inherent viscosity of 0.78. By treating this solution the same as in Example 17, it was possible to obtain a tenacious, heat resistant film.

EXAMPLE 19

In 220 parts of N-methylpyrrolidone, 82.278 parts of p-aminobenzoic acid was dissolved, to the resultant solution 241.665 parts of solid benzophenonetetracarboxylic dianhydride was added and the mixture was heated at 190° – 200° C for 2 hours to synthesize an adduct. To the reaction solution obtained, 189.165 parts of diphenylether-4,4'-diisocycnate was added together with 260 parts parts of N-methylpyrrolidone and the mixture was polymerized at 160° C for 2 hours. This polymer had a polymer concentration of 55% and an inherent viscosity of 0.75. The ratio of ring closing was 80%. By treating this polymer the same as Example 17, a tenacious, yellowish brown polyamide-imide film was obtained. This film had a folding endurance of 8000 times and a tenacity of 10.0 kg/mm$^2$.

EXAMPLE 20

In N-methylpiperidone, 482.3 parts of 1,4,5-naphthalenetricarboxylic anhydride and 247.26 parts of m-aminobenzoic acid were reacted at 190° – 200° C for 4 hours. To the reaction product of 954.0 parts of N,N'-dimethoxycarbonyl-4,4'-diaminodiphenylether and 166.0 parts of ispohthalic acid were added, and when the mixture was polymerized at 190° C for 2 hours, it became a highly viscous polymer solution having a viscosity of 2000 poises, a polymer concentration of 61% and an inherent viscosity of 0.86. While heating this solution at 175° C, said solution was continuously supplied to an extruder heated to 175° C and melt extruded in a film state from a spinneret heated to 175° C. The film coming from the spinneret was cast onto a metal drum cooled to 20° C, and thereafter cooled to be solidified. Said film was continuously introduced into a tenter type heat treating apparatus heated to 310° C and heat treated for about 5 minutes. The film obtained was brown and rich in flexability. This film had a tensile strength of 10.2 kg/mm$^2$, an elongation of 16.5% and a folding endurance of 5800 times. Even when this film was treated in air at 250° C for 10 hours, no substantial change of physical properties took place and the film exhibited good heat resistance.

EXAMPLE 21

In 600 parts of N-methylcaprolactam, 282.36 parts of 1-amino-4-carboxylcyclohexane was dissolved, to the solution obtained 218.12 parts of pyromellitic dianhydride was added and the mixture was reacted at 200° C for 2 hours to obtain an adduct having a ratio of ring closing of 85%. To this reaction solution, 373.3 parts of diphenylmethane-4,4'-diisocyanate was added and the mixture was reacted at 160° C for 5 hours to make a polymer solution having an inherent viscosity of 0.58 (polymer concentration 56%). This polymer solution was extrusion shaped and heat treated the same as in Example 14; however, the extruding temperature was made 180° C and the heat treating temperature was made 350° C. The film obtained had a folding endurance of 7500 times and a dielectric strength of 201 KV/mm.

EXAMPLE 22

In 5.1 parts of N-methyl-2-pyrrolidone, 2.014 parts of bis (trimellitic anhydride) anhydride, 0.2743 part of p-aminobenzoic acid and 1.4517 parts of 4,4'-diaminodiphenylether were reacted at room temperature. At first, it was a system wherein the insoluble components co-existed, however, they were gradually dissolved and the system became a uniform solution in 2 hours. This solution was heated at 190° C and water was completely distilled out of the system. However, upon this occasion because NMP was also distilled off together with water, NMP in an amount corresponding to the amount distilled off was supplemented. After 2.5 hours, while the temperature was kept at 180° C, 0.8646 part of trimellitic anhydride was added to said solution, to the mixture 2.0646 parts of 4,4'-diphenylmethane diisocyanate in solid state were gradually added further. The polymerization proceeded accompanied with vigouous generation of $CO_2$ and 50 minutes after completion of the addition, the solution viscosity of the system rose to 5000 poises at 180° C. After 1 hour, because said viscosity became roughly constant at 5500 poises at 180° C, the reaction container was connected directly to the extruder disclosed in Example 13 and the polymer was melt extruded from a spinneret heated to 170° C. This polymer solution was in the solid state accompanied with some elasticity at 25° C, having a polymer concentration of 57% and an inherent viscosity of 1.0.

EXAMPLE 23

In 2.5 parts of NMP, 0.2743 part of m-aminobenzoic acid and 0.8646 part of trimellitic anhydride were stirred and dissolved at room temperature. To the solution obtained, 1.0987 parts of bis (trimellitic anhydride) anhydride and 0.6443 part of 4,4'-diaminodiphenylmethane were added in solid state, while the temperature inside the reaction container was kept below 20° C by cooling with water, the mixture was stirred and reacted for 1.5 hours. Subsequently, heating was started and water was distilled together with NMP out of the system. After the mixture was heated at 180° C and stirred for 3 hours, 2.4399 parts of 4,4'-biphenylmethane diisocyanate in a molten state was added dropwise to the mixture. The polymer solution obtained by reacting the resultant mixture at 180° C for 1.5 hours after completion of the dropping had a solution viscosity of 7000 poises at 180° C, a polymer concentration of 53% and an inherent viscosity of 1.2. (RS — percentage of polymer base — 89%). This solution was supplied to an extruder heated to 160° C and melt extruded from a spinneret heated to 170° C in a film state. The film coming out of the die was immediately introduced onto a metal belt heated to 280° C and heat treated for 7 minutes. The film obtained had a tensile strength of 12.4 kg/mm², an elongation of 27% and a folding endurance (50μ thick) of 12000 times.

EXAMPLE 24

In 5.8 parts of NMP, 2.0142 parts of bis (trimellitic anhydride) anhydride, 0.8056 part of benzophenone-tetracarboxylic anhydride and 0.3843 part of trimellitic anhydride were suspended, while the reaction container was cooled by water, 1.9826 parts of 4,4'-diaminodiphenylmethane were added as flakes to the suspension obtained. After the mixture was stirred at a temperature below 20° C for 1 hour, the temperature was elevated and at 190° C the mixture was further stirred and reacted. Upon this occasion water created by closing of an imide ring was distilled out of the system together with NMP and NMP in an amount corresponding to the amount distilled off was supplemented. Next, the temperature inside the reactor was lowered to 150° C, into which 1.2513 parts of 4,4'-diphenylmethane diisocyanate in the solid state was thrown in one batch and when the temperature was elevated to 190° C in 30 minutes, after 2.5 hours a polymer solution exhibiting a solution viscosity at 190° C of 4200 poises was obtained. This polymer solution had a polymer concentration of 50% (RS 100%) and an inherent viscosity of 1.3.

This solution was supplied to a vent type extruder having a diameter of 30 mm heated to 170° C and melt extruded and made into a film from a spinneret heated to 170° C. The tan S (22° C, 1 KC/S) of the film after it was heat treated was 0.0022.

EXAMPLE 25

In 30 parts of NMP, 8.2400 parts of bis (trimellitic anhydride) anhydride and 4.4609 parts of 4,4'-diaminodiphenylmethane were reacted at room temperature for 1 hour and at 200° C for 3 hours. To the resulting solution 17.1182 parts of imidedicarboxylic acid of the following formula having been synthesized in advance from trimellitic anhydride and p-aminobenzoic acid

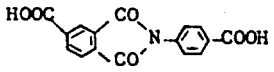

and 4.3229 parts of trimellitic anhydride were added in particulate state, further, 30 parts of NMP and 25.222 parts of 4,4'-diphenylether diisocaynate were added in the solid state to the resultant mixture and the mixed solution obtained was reacted at 180° C for 2 hours to obtain polyamide-imide. The polymer solution had a solution viscosity of 8000 poises at 180° C, a polymer concentration of 62% and an inherent viscosity of 0.89. In accordance with the method in Example 14, a tenacious polyamide-imide film was obtained. This film had a tensile strength of 11.3 kg/mm², an elongation of 23.0% and a folding endurance (50μ thick) of 9000 times.

EXAMPLE 26

In 150 parts of tetrahydrofuran, 13.7 parts of p-amino-benzoic acid were dissolved. To the solution obtained, 19.21 parts of trimellitic anhydride were added. Upon this occasion, in order that the reaction temperature might not become more than 30° C, the reaction system was cooled by means of an ice bath.

After the mixture was stirred at room temperature for 1 hour, 15 parts of dimethyl formamide was added thereto and after making the reaction solution uniform, 22 parts of dicyclohexylcarbodiimide dissolved in 200 parts of tetrahydrofuran were added dropwise. After the resultant mixture was stirred at room temperature for 4 hours, the precipitated dicyclohexyl urea was removed by filtration. The filtrate was thrown into n-hexane in an amount 3 times that of the filtrate to obtain the following compound

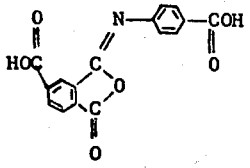

In 5.2 parts of N-methylpyrrolidone, 3.112 parts of this compound was dissolved. To the solution obtained, 2.502 parts of diphenylmethane-4,4'-diisocyanate were added and when the obtained mixture was stirred at 190° C for 3 hours, it became a viscous polymer solution. This polymer solution had a solution viscosity of 4600 poises at 190° C, a polymer concentration of 48.0% and an inherent viscosity of 1.10. When the infrared absorption spectrum of this polymer solution was taken, the characteristic absorption of an iminolactone ring had disappeared. This polymer was made into a film and heat treated the same as in Example 2 to obtain a tenacious and flexible film.

EXAMPLE 27

In 3.2 parts of NMP, 1.7118 parts of iminolactonedicarboxylic acid synthesized from p-aminobenzoic acid and trimellitic acid by a method as described in Example 26 were completely dissolved. To the solution obtained, an equimolar amount of dried ethyl alcohol was added dropwise at a temperature below 0° C and when the mixture obtained was reacted at 50° C for 5 hours, the following amidoesterdicarboxylic acid was produced.

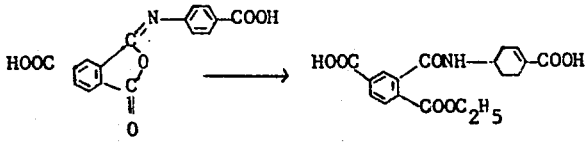

According to the infrared absorption spectrum, the characteristic absorption of an iminolactone ring at 5.81μ and 5.50μ disappeared. It was understood that an ester bond was produced anew, while no imide ring was produced at all. In an NMP solution of this amidoesterdicarboxylic acid, 0.8646 part of trimellitic anhydride and 2.5025 parts of 4,4'-di-phenylmethane diisocyanate were added in the solid state and the mixture was elevated in temperature to 120° C in 2 hours. When the mixture was further heated and reacted at 180° C for 5 hours, a very highly viscous polymer solution having a solution viscosity of 8300 poises at 180° C was obtained, the polymer concentration thereof was 60% and its inherent viscosity was 0.82. The polymer obtained was made into a film according to the method in Example 2.

EXAMPLE 28

In N,N-dimethyl formamide, 2 moles of trimellitic anhydride and 1 mole of 4,4'-diaminodiphenylmethane were reacted at a temperature lower than −10° C using phosphorus trichloride to synthesize a dicarboxylic acid having an iminolactone ring. To this yellowish orange reaction solution, methyl alcohol was added dropwise at a temperature below 0° C, when the solution obtained was reacted at room temperature for 5 hours and water was poured onto the light yellow solution obtained, light yellow particulate crystals were salted out. Said particulate crystals were dried in a vacuum drier at 50° C for 10 hours to obtain roughly quantitatively the following amidoesterdicarboxylic acid.

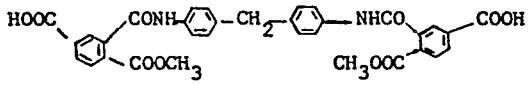

In 4.0 parts of NMP, 3.6633 parts of this substance and 0.7685 part of trimellitic anhydride were dissolved. To the solution obtained 2.5025 parts of solid 4,4'-diphenylmethanediisocyanate were added and when the resultant mixture was reacted while being heated to 12.'' C for 2 hours, a highly viscous polymer having a solution viscosity of 10,000 poise at 190° C, a polymer concentration of 65% (RS 54%) and an $\theta_{inh}$ of 0.96 was obtained. From this polymer, according to the method of Example 2, a tenacious polyamide film exhibiting good heat resistance was obtained.

EXAMPLE 29

An NMP solution of polyhydantoin obtained by thermal polymerization of diethyl-m-phenyleneglycinate and 4,4'-diphenylmethane diisocyanate (solution viscosity of 8000 poises at 190° C, polymer concentration 59% (RS 70%), $\theta_{inh}$ 0.72) was melt extruded in accordance with the method in Example 14. The polyhydantoin film obtained was yellowish brown and very tenacious.

EXAMPLE 30

An NMP solution of polyhydantoin obtained from 4,4'-bis (N-carboethoxymethyl-N-carboethoxy)-diphenylmethane and 4,4'-diphenylether diisocyanate (polymer concentration 53%, RS 88%, $\theta_{inh}$ 0.68) was heat melt extruded and made into a film in accordance with the method in Example 14. The polyhydantoin film obtained exhibited good heat resistance.

EXAMPLE 31

In 289 g of NMP, 234.2 g of butanetetracarboxylic acid (BTC) and 198.3 g of 4,4'-diaminodiphenylmethane (DAM) were dissolved, the solution was stirred and heated to elevate the temperature to 200° C. In order to supplement NMP and water distilled out during the period, NMP in an amount corresponding to the amount distilled out was added to the system. A viscous solution obtained after 4 hours was considered a high molecular weight compound mixture having the following structure supposed from the infrared spectrum and the like. The ratio of ring closing of this high molecular weight compound mixture was 85%.

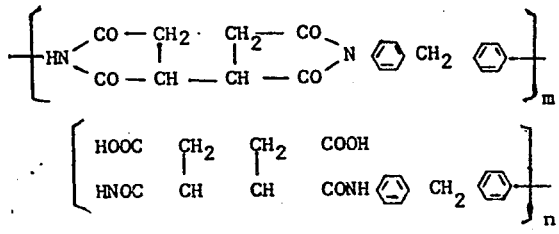

This solution was concentrated under a reduced pressure to prepare samples having solvent concentrations (based on the weight of the polymer) of 8, 13, 21, 40, 58, 67 and 72%. These samples were 67 into small lumps and supplied to an extruder having a diameter of 20 mm heated to 180° C. At the tip of the extruder, a 150 mm wide film making spinneret was provided, which spinneret was also heated to 180° C. At first when the sample having a solvent concentration of 8% was charged, the product from the spinneret seemed somewhat carbonized and even when it was cooled by a cooling drum, it did not become filmy at all. When the sample having a solvent concentration of 13% was charged, it tentatively flowed out from the spinneret in a molten state and when it was cooled by a cooling drum (20° C), a filmy or sheet-like product was obtained. Subsequently, when samples having solvent concentration values of 21, 40 and 58% were melt extruded, they were extruded in filmy states from the spinneret without problems and by cooling them with a cooling drum, yellowish transparent films were obtained. The sample having a solvent concentration of 67% came out of the spinneret without problems. However, even after being cooled by a cooling drum, it was considerably viscous and seemed like a limit of products that retain their self-supporting property. Finally, when the sample having a solvent concentration of 72% was extruded, it was smoothly extruded in a filmy state from the spinneret, however, even when it was cooled by a cooling drum, it still had no self-supporting property and could not be made into a solid film. By heat treating films obtained from the materials having solvent concentration values of from 21 to 67% at 200° C for 2 minutes, at 250° C for 3 minutes and at 300° C for 3 minutes, light yellow tenacious films were obtained. The ratios of ring closure inside the molecules of these films were roughly 100%. When the melting points of these films were measured, there were no melting points and when they were heated to a temperature above 350° C, they began to decompose. These films had tensile strengths of 11.6 kg/mm$^2$and elongations of 13%, exhibiting excellent heat resistances.

EXAMPLE 32

In NMP, BTC abd 4,4'-diaminodiphenylether (DAE) were thermally polymerized to obtain a solution having a solvent viscosity of 100% (polymer concentration 50%). This solution was heated to 80° C under a reduced pressure and concentrated to make the solvent concentration 32%. The polymer obtained was pulverized to make it a particulate material. In spite of containing 32% of the solvent, these particles were dry and the ratio of ring closure inside the molecule was 75%.

These particles were supplied to a small candle type spinning machine, melt spun at 190° C, cooled by air, thereafter, the solidified filaments were wound around a heating roller and heat treated at 300° C. The filaments obtained were slightly brown and tenacious.

EXAMPLE 33

In NMP, trimellitic acid chloride and DAM were polymerized to obtain a solution of the following polyamide-imide precursor mixture.

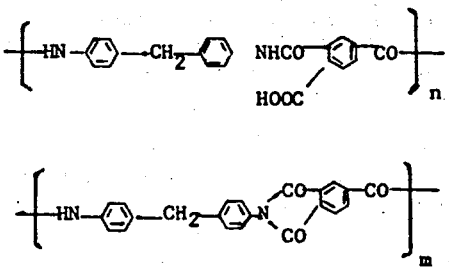

After this solution was suspended in a poor solvent of methanol-water type, using a large amount of water, the polymer was precipitated again, filtered and dried to obtain a particulate polymer hardly containing any organic solvent. The ratio of ring closure inside the molecule of this polymer was 33%. The polymer per se was supplied to an extruder heated to 170° C and attempts were made to melt extrude it. However, the polymer was not dissolved and the extrusion attempts did not succeed. subsequently, said particulate polymer was left to stand in a vapor of NMP to cause NMP to permeate inside the particles so that the solvent concentration became 23%. Even after the solvent concentration became 23%, the particles were not wet, but dry. When these particles were supplied to an extruder heated to 170° C and melt extruded, said particles were melted simply and came out after being shaped into a filmy state from a T type spinneret for making a film (which was also heated to 170° C). When this molten film was wound around a metal drum cooled to 20° C to be cooled and solidified, a lightly yellowish, beautiful film was made. This film was soluble in NMP and DMAC and when heated to a temperature higher than 120° C, it was softened. This film was placed inside a tenter type heat treating machine, heated from both surfaces by radiation heaters so that the temperature of the film became 280° – 300° C, and heat treated for about 6 minutes. The film obtained had a ratio of ring closure inside the molecule of 100%, being yellowish and tenacious, insoluble in organic solvents and failing to have a melting point. This film had a tenacity of 12 kg/mm², an elongation of 42% and even when it was kept in an atmosphere at 180° C for a long period of time, no substantial change of its physical properties was caused and said film exhibited excellent heat resistance.

EXAMPLE 34

By polymerizing trimellitic acid chloride, hydroquinone and 4,4′-diaminodiphenylmethane in DMAC, a polyesterimide precursor mixture as shown by the following formulae was obtained. The ratio of ring closing inside the molecule of said precursor mixture was 63%.

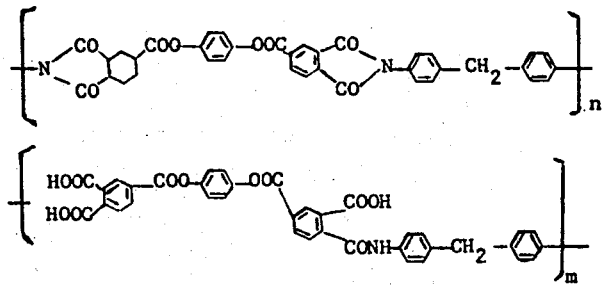

After this DMAC solution was heated and dried, it was pulverized into pellets. The pellets obtained had a solvent concentration of 50%. These pellets were heated to 150° C, supplied to a vent type extruder, and while removing some amount of the solvent from the vent, said pellets were melt extruded in a filmy state, and after the film obtained was cooled and solidified by a drum for cooling, it was heat treated at 250° C. The film obtained was a brownish, tenacious polyesterimide film. The ratio of ring closing inside the molecules of said film was roughly 100%.

EXAMPLE 35

Using DAM, PMDA and IPC at a molar ratio of 2:1:1, they were copolymerized in NMP to obtain a high molecular weight compound solution having a logarithm viscosity of 0.8 and a ratio of ring closing inside the molecule of 55%. This solution was treated the same as in Example 33 to obtain a tenacious, heat resistant film.

EXAMPLE 36

Using 4,4′-diaminodiphenylether and benzophenonetetra-carboxylic dianhydride at a molar ratio of 1:1, they were copolymerized in DMAC to obtain a high molecular weight compound solution having an inherent viscosity of 0.9 and a ratio of ring closure inside the molecule of 70%. By treating this solution the same as in Example 33, it was possible to obtain a tenacious, heat resistant film.

EXAMPLE 37

Using trimellitic anhydride (TMA) and methylenediphenylene diisocyanate (MDI) at a molar ratio of 1:1, they were heated and polymerized in NMP. The polymerization proceeded while generating carbon dioxide and a very viscous high molecular weight compound solution was obtained. This high molecular weight compound solution had a solvent concentration of about 50%, an inherent viscosity in NMP at 30° C of 1.3 and a ratio of closing of an imide ring inside the molecule of 72%. This solution was continuously supplied to an extruder heated to 140° C and continuously heated to 140° C and melt extruded in a filmy state from a spinneret heated to 150° C. The film coming out from the spinneret was wound around a metal drum cooled to 20° C to be cooled and solidified, and continuously introduced to a tenter type heat treating machine heated to 280° C and heat treated for about 5 minutes. The film obtained was dark drown, having a ratio of imide ring closure of roughly 100% and failing to have a melting point.

This film had a tensile strength of 12.7 kg/mm², an elongation of 22% and even when it was treated in air at 250° C for 10 hours, no substantial change of physical properties was found, the product exhibiting good heat resistance.

EXAMPLE 38

In 250 parts of tetrahydrofuran, 38.42 parts of trimellitic anhydride were dissolved, the resultant solution was cooled to 0° C, to which solution 19.83 parts of solid 4,4'-diaminodiphenylmethane was added little by little. After the mixture was reacted at 0° – 10° C for 2 hours, 44.4 parts of dicyclohexylcarbodiimide dissolved in 500 parts of tetrahydrofuran were added thereto dropwise. The reaction temperature within the system was kept at 0° – 10°C. After the resultant mixture was reacted at 20°C for 10 hours, the reaction product was filtered to remove dicyclohexyl urea to obtain diiminolactonedicarboxylic acid (I).

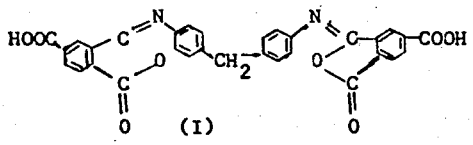

(I)

In 200 parts of N-methyl-2-pyrrolidone, 29.1 parts of the compound (I) were dissolved. To the solution obtained, 12.51 parts of solid diphenylmethane diisocyanate were added and when the mixture was heated at 180°C for 5 hours, it became a viscous polymer solution (the ratio of ring closing of this polymer was 96%).

After the polymer solution was concentrated, while the temperature was kept at 180°C, the concentrated polymer solution was continuously supplied to a small extruder heated to 190°C and melt extruded and made into a film from a spinneret also heated at 190°C. The molten film coming out from the spinneret contained 93% of a solvent. After it was cooled by a casing drum, it was continuously introduced into a tenter type heat treating apparatus heated at a temperature gradient of 260° – 320°C and a complete ring closure heat treatment was carried out. The film obtained had a tenacity of 15.1 kg/mm$^2$, an elongation of 12% and a folding endurance (thickness 50$\mu$) of 1100 times.

EXAMPLE 39

In 25 parts of N-methylpyrrolidone as a solvent, 8.008 parts of 4,4'-diaminodiphenyletherdiamine and 7.324 parts of bis (trimellitic anhydride) anhydride were stirred at room temperature for 30 minutes. Thereafter; they were heated and stirred while nitrogen was flowed at 190°C for 5 hours. The highly viscouos polymer solution produced was continuously supplied to a small extruder heated to 190°C and melt extruded and made into a film from a spinneret heated also at 190°C. The molten film coming out from the spinneret containing 101% of a solvent was cooled by a casting drum at −20°C, thereafter, continuously introduced into a tenter type heat treating apparatus heated to 120°C and heat treated under tension. The film produced was brown and tenacious, having a tendency of 16.5 kg/mm$^2$ and an elongation of 18.5%.

EXAMPLE 40

By polymerizing isophthalic acid dihydrazide and pyromellitic anhydride in NMP, a solution of a precursor mixture shown by the following formulae was obtained. The ratio of ring closure inside the molecule was 60%.

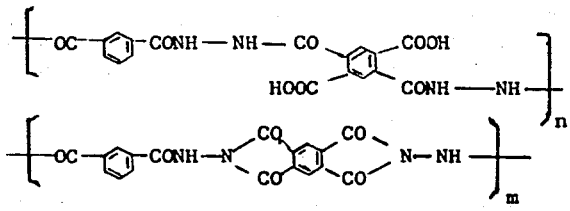

After this solution was heated and concentrated at 70°C under a reduced pressure to make the solvent concentration 92%, the concentrated solution was supplied to an extruder heated to 170°C and melt extruded and made into a film. After the film coming out from the spinneret was wound around a cooling drum to be cooled and solidified, it was heat treated in hot air at 100°C for 5 minutes. The film obtained was transparent and somewhat yellowish and tenacious.

EXAMPLE 41

Using 4,4'-diaminodiphenylmethane (DAM), pyromellitic diahydride (PMDA), trimellitic acid chloride (TMC) and isophthalic acid chloridde (IPC) at a molar ratio of 3:1:1:1, they were copolymerized in NMP to obtain a high molecular weight compound solution having an inherent viscosity at a concentration of 0.5% in NMP at 30°C of 0.80. The ratio of ring closing in said high molecular weight compound was 52%. This solution was concentrated under a reduced pressure to make the solvent concentration 77%, the concentrated solution was supplied to an extruder having a diameter of 30 mm heated to 140°C and melt extruded and made into a film from a spinneret heated to 150°C. After the thin film coming out from the spinneret was wound around a metal drum cooled to −10°C to be cooled and solidified, the film was preliminarily heat treated by a hot air drier heated to 200°C, continuously introduced into a tenter type heat treating apparatus heated to 280°C and heat treated under tension. The film obtained was a tenacious yellowish brown one, having a ratio of ring closing inside the moledule of 100% and failing to have a melting point.

EXAMPLE 42

Using DAM and PMDA at a molar ratio of 1:1, they were polymerized in NMP to obtain a high molecular weight compound solution having an inherent viscosity at a concentration of 0.5% in NMP at 30°C of 0.50, an amount of solvent of 78% and a ratio of ring closing inside the molecule of 80%. By treating this solution the same as in Example 39, it was possible to obtain a tenacious, heat resistant film.

EXAMPLE 43

Using DAM, TMC and IPC at a molar ratio of 2:1:1, they were copolymerized in NMP to obtain a high molecular weight compound solution having an inherent viscosity of 0.7, an amount of solvent of 73% and a ratio of ring closing inside the molecule of 60%. By treating this solution the same as in Example 39, it was possible to obtain a tenacious, heat resistant film.

EXAMPLE 44

Using 4,4'-diaminodiphenylether and benzophenonetetracarboxylic dianhydride at a molar ratio of 1:1, they were polymerized in DMAC to obtain a high molecular weight compound solution having an inherent viscosity of 0.9, an amount of a solvent of 75% and a ratio of ring closing inside the molecule of 70%. By treating this solution the same as in Example 39, it was possible to obtain a tenacious, heat resistant film.

EXAMPLE 45

In 650 g of NMP, 234.2 g of butane-1,2,3,4-tetracarboxylic acid (BTC) and 198.3 g of 4,4'-diaminodiphenylmethane (DAM) were dissolved, the solution obtained was stirred and heated to elevate the temperature to 200°C. In order to supplement NMP and water distilled out during the period, NMP in an amount corresponding to the amount distilled out was added periodically to the system. A polymer solution obtained after 4 hours was considered a high molecular weight compound mixture having the following structures determined from the infrared spectrum and the like. The ratio of ring closure inside the molecule of this high molecular weight compound mixture was 85%.

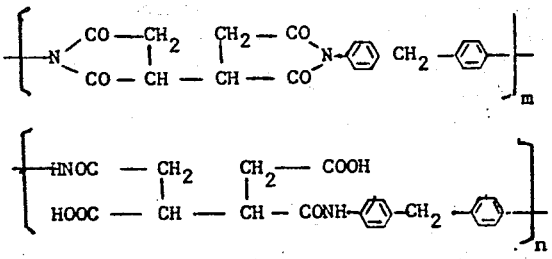

This solution was concentrated under reduced pressure to prepare samples having solvent concentrations (based on the weight of the polymer) of 40%, 55%, 137%, and 155%. All of these samples were solid at room temperature (however, the sample having the solvent concentration of 55% was not in a completely solid state). These samples were pulverized to make them particulate. Thereafter, these particles were supplied to an extruder having a diameter of 20 mm heated to 160°–180°C and extrusion shaped (the die was a 150 mm wide slit). As to the extrusion shapability, the sample having the solvent concentration of 155% was very poor in shape retentivity and its extrusion from the die was not carried out smoothly. However, the rest of the samples were able to retain their shapes and could be extrusion-shaped smoothly. On the other hand, the extruded product was placed on a metal belt, cooled to room temperature and peeled therefrom, however, except the sample having the solvent concentration of 40%, peeling of the rest was not easy and smooth as the amount of solvent increased and in the case of the sample having the solvent concentration of 137% the peeling is very difficult. Therefore, before a metal drum a water bath of a temperature of 30°C was provided at a position 10 cm below the extruding die and extrusion shaping was carried out so as to wind the extruded product around the drum after dipping. As a result, from the sample having the solvent concentration of 137%, a film having a self-supporting property was obtained without destroying the shape of the extruded product. Again, upon peeling the film off the drum around which the film had been wound, it was confirmed that peeling could be carried out without any significant problems and the film could be continuously supplied to the subsequent heat treatment step. Next, the samples having 55 and 137% of the solvent were heat treated at 200°C for 2 minutes, 250°C for 3 minutes and 300°C for 3 minutes, and tenacious light brown films were obtained. The ratios of ring closing inside the molecules of these films were roughly 100%. When the melting points of these films were measured, there were no melting points. However, when they were heated to a temperature higher than 350°C, they began to decompose. These films had tensile strengths of 14 – kg/mm² and elongations of 28 – 32%. When contacted with water, the surfaces of these films became somewhat white and opaque, however, upon being heated that color disappeared and became transparent.

EXAMPLE 46

A three-necked flask equipped with a stirrer and a nitrogen inlet tube was charged with 68.486 parts of N,N'-diethoxycarbonyl-4,4'-diaminodiphenylmethane, 38.424 parts of trimellitic anhydride and 200 parts of N-methylpyrrolidone, and the contents were stirred at 195° – 200°C for about 2 hours to effect polymerization. The polymer obtained was very viscous, having a viscosity at 150°C of more than 3000 poises and a ratio of ring closure of 98%. After completion of the polymerization operations, while the polymerization temperature was kept at 170°C, the polymer was continuously supplied to a small extruder heated to 170°C and melt extruded and made into a film from a spinneret heated also to 170°C. Of the molten film coming out from the spinneret, 4/5 was cast on a casting drum immersed in heptane, thereafter, heptane was removed by nip rolls, continuously introduced to a tenter type heat treating apparatus heated to 200°C and heat treated under tension.

The film obtained was a tenacious, yellowish brown one having a tenacity of 16 kg/mm² and a folding endurance (thickness 50$\mu$) of 1200 times.

On the other hand, the molten film was similarly received by the casing drum without being passed through heptane, thereafter, the temperature was recovered to room temperature and the film was peeled, however, the film adhered to the drum and the peeling of the film from said drum was difficult.

EXAMPLE 47

In 250 parts of tetrahydrofuran, 38.42 parts of trimellitic anhydride was dissolved, the resultant solution was cooled to 0°C, to which 19.83 parts of 4,4'-diaminodiphenylmethane in the solid state was added little by little.

After the mixture obtained was reacted at 0° – 10°C for 2 hours, 44.4 parts of dicyclohexylcarbodiimide dissolved in 500 parts of tetrahydrofuran was added dropwise to the reaction product. The reaction temperature within the system was kept at 0° – 10°C. After the reaction product was reacted for 10 hours, the resultant reaction product was filtered to remove dicyclohexyl urea to obtain diiminolactonedicarboxylic acid.

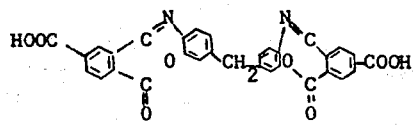

In 200 parts of N-methyl-2-pyrrolidone, 29.1 parts of the diiminolactonedicarboxylic acid were dissolved. To the resultant solution, 12.51 parts of solid diphenylmethane diisocyanate were added. When the mixture was heated at 180°C for 5 hours, it became a viscous polymer solution. While the polymerization temperature was kept at 180°C, the polymer solution was continuously supplied to a small extruder heated to 190°C. The solvent concentration was 150%. The molten film emerging from the spinneret was cast into water to acquire a self-supporting property. Immediately thereafter the film was preliminarily heat treated in a hot air drier heated to 220°C and was introduced continuously into a tenter type heat treating apparatus to carry out a complete desolvation, ring closing heat treatment.

The film obtained had a tenacity of 16.2 kg/mm$_2$, an elongation of 18% and a folding endurance (thickness 50$\mu$) of 1450 times.

On the other hand, the molten film was not cast into water, but wound around a metal drum cooled to −10°C to be cooled and thereafter the film was peeled off from said drum. However, during the peeling the film was torn.

EXAMPLE 48

In 250 parts of N-methylpyrrolidone, 105.672 parts of trimellitic anhydride was dissolved. To the resultant solution, 75.422 parts of p-aminobenzoic acid were added in solid state and the mixture was heated and stirred at 200°C for 2 hours. Water produced in the process was distilled out of the system and the final ratio of moisture was 115 ppm. To this slurrylike solution, 250.250 parts of 4,4′-diphenylmethane diisocyanate and 86.459 parts of trimellitic anhydride were added and when the resultant mixture was continuously stirred at 170°C for 1.5 hours, a very highly viscous polymer (ratio of ring closing 96%) was obtained. To the polymer obtained, a small amount of N-methylpyrrolidone was added and the mixture was further stirred well, in a manner to prepare polymers having A logarithm viscosity of 0.96, solvent concentrations of 83 and 102%. Each of the two polymers was extruded in a filmy state by an extruder having a diameter of 40 mm. Thereafter, the films were received through rolls inside a water vessel, introduced via nip rolls to a tenter type heat treating machine and continuously heat treated at a temperature from 250° to 330°C elevated step by step in 10 minutes. The spinneret of the extruder was a T die and the lip gap was 0.2 mm. When the films were passed through the water, they simply changed to self-supporting films and did not adhere to the rolls. The heat treated films were yellowish, transparent, tenacious ones and after both ends of the films were cut, the films were wound around a paper mandril. The thicknesses of the films were both 50$\mu$, the films had tensile strengths of 14 kg/mm$^2$, elongations of 44%, dielectric strength of 190 – 193 KV/mm and folding endurance of 6700 – 6800 times. After being passed through water, the surfaces of the films became white and opaque. However, the white color completely disappeared after the heat treatment.

EXAMPLE 49

In 7.2 parts of NMP, 1.8311 parts of bis (trimellitic anhydride) anhydride and 3.7242 parts of 3,3′-diaminodiphenylsulfone were reacted at room temperature for 30 minutes and at 50°C for 2 hours. Thereafter, the reaction product was reacted at 190°C for 3 hours to close an imide ring. A part of the reaction solution was re-precipitated with a large amount of water, the light yellow crystals obtained were dried and when the infrared absorption spectrum thereof was taken, roughly more than 95% of an imide ring was closed and an amide acid bond which was a precursor thereof was less than 5%. To this reaction solution, 1.2513 parts of 4,4′-diphenylmethane diisocyanate was added and the mixture was polymerized at 180°C for 2 hours to obtain a polymer solution of a high degree of polymerization having a solution viscosity of 3200 poises at 180°C, a polymer concentration of 45% (RS 122%) and an inherent viscosity of 1.5. From this solution, a film was made the same as in Example 45. The characteristics of the film after being heat treated at 300°C for 5 minutes were a tensile strength of 15.8 kg/mm$^2$, an elongation of 24% and a folding endurance (50$\mu$thick) of 11,500 times.

EXAMPLE 50

To a particulate polymer of polybenzooxazole synthesized from 4,4′-isopropylidene-bis(2-aminophenol) and 4,4′. -diphenyletherdicarboxylic acid dichloride (ratio of ring closing inside the molecule 25%), NMP was added so as to make the solvent concentration (RS) 85%, the mixture melted at 190°C was heat, melt extruded according to the method in Example 39 and the extruded product was heat treated under tension.

EXAMPLE 51

In NMP, 3,3′,4,4′-tetraaminodiphenylether and isophthalic acid diphenyl ester were reacted at 190°C for 3 hours to obtain a highly viscous polymer solution having a polymer concentration of 55% (RS 82%) and an inherent viscosity of 1.3. This polymer solution was made into a film and heat treated according to the method in Example 39 to make it a tenacious polybenzoxmidazole film. This film had a tensile strength of 20.8 kg/mm$^2$ and a folding endurance (thickness of the film 50$\mu$) of 25,000 times.

EXAMPLE 52

In NMP, 5,5′-methylene-bis(anthranyl acid) and 4,4′-diphenylether dicarboxylic acid diphenyl ester were reacted at 190°C to obtain a highly viscous polymer solution having a polymer concentration of 55% (RS 82%) and an inherent viscosity of 1.1. This polymer solution was melt extruded at 90°C and heat treated at 300°C in accordance with the method in Example 39 to obtain a heat resistant polybenzoxadinone film as shown in the following formula.

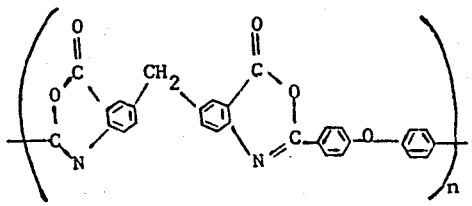

EXAMPLE 53

In N-methylpiperidone, 3,3′,4,4′-benzophenonetetracarboxylic dianhydride and 3,3,4,4′-tetraaminodiphenylether were reacted at 200°C for 2 hours to obtain a polymer solution ($\theta_{inh}$ 0.7). This polymer solution was melt extruded at 190°C and heat treated at 340°C according to the method in Example 39. The produced polyimidazopyrrolone film was yellowish brown and rich in flexibility.

EXAMPLE 54

Polyoxadiazole powder synthesized from isophthaloyl dihydrazide and isophthalic acid dichloride was reached with $P_2S_5$ in hexamethylphosphoramide (HMPA) to make polythiadiazole. An HMPA solution of this polythiadiazole (RS 95%, $\theta_{inh}$ 0.92) was melt extruded and heat treated in accordance with the method in Example 39 to obtain a tenacious, heat resistant film.

EXAMPLE 55

In DMAC, 5-amino-2-(m-aminophenyl) benzoxazole and 3,3',4,4'-benzophenonetetracarboxylic dianhydride were reacted at 0°C for 5 hours and at 160°C for 5 hours to obtain polybenzoxazole (ratio of closure of an imide ring 98%) solution (RS 102% $\theta_{inh}$ 0.96) which was melt extruded at 155°C and thereafter heat treated at 320°C in accordance with the method in Example 39 to make a film. The obtained (50$\mu$thick) film had a tensile strength of 18.6 kg/mm$^2$, an elongation of 18% and a folding endurance of 23,000 times.

The following is claimed:

1. The process for the manufacture of heat resistant polymeric film comprising the steps of:

1. extruding into film at high temperature a flowable polymer composition containing solvent, which composition may be handled as a solid at room temperature, said composition being comprised of (a) a polymer having in the repeating units thereof, a member selected from the group consisting of precursor units which on heat curing form heterocyclic rings, and a mixture of said precursor units and heterocyclic rings formed from such precursor units, said polymer being selected from the group consisting of polyamide-imide, polyimide, and polyamide-acid and containing at least 15% of said heterocyclic rings by weight of said polymer and (b) 25–130% by weight of an organic solvent based on the weight of said polymer, said solvent being selected from the group consisting of N-methyl-2-pyrrolidone (NMP), N,N-dimethylacetamide (DMAC), N,N-dimethylformamide (DMF), N,N-dimethylmethoxy acetamide, N-methylcaprolactam, dimethyl sulfoxide, tetramethyl urea, pyridine, dimethylsulfone, hexamethylphosphoramide, tetramethylene sulfone, formamide, butyrolactam, N-acetylpyrrolidone, m-cresol and P-cresol, said polymer composition being normally solid at room temperature, said extrusion being carried out to form film at a temperature above room temperature and below the curing temperature of said polymer, immersing said extruded film in a liquid which is miscible with the solvent in said film, said polymer being insoluble in said liquid, said liquid being selected from the group consisting of water, aliphatic and aromatic hydrocarbons, hydrocarbon halides and ketones, and
2. thereafter curing said uncured film with an effective amount of heat sufficient to causes ring closure of said precursor units, hereby forming said heat resistant polymeric film.

2. The process according to claim 1 wherein the heat resistant polymer is polyamideimide.

3. The process according to claim 1 wherein the heat resistant polymer is polyesterimide.

4. The process according to claim 1 wherein said polymer composition has a softening point of less than 270°C.

5. The process according to claim 1 wherein the heat treating temperature is 200°–500°C.

6. The process according to claim 1 wherein said polymer composition is extruded at a temperature of no more than 350°C., and no less than 30°C., above that to which the composition is exposed immediately after extrusion to form a shaped article which is thereafter heat treated.

7. The process according to claim 1 wherein said polymer composition after it has been extruded is heat treated prior to the complete solidification thereof.

* * * * *